US007932801B2

(12) United States Patent
Loef

(10) Patent No.: US 7,932,801 B2
(45) Date of Patent: Apr. 26, 2011

(54) WINDING ARRANGEMENT FOR PLANAR TRANSFORMER AND INDUCTOR

(75) Inventor: Christoph Loef, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 116 days.

(21) Appl. No.: 11/913,323

(22) PCT Filed: Apr. 28, 2006

(86) PCT No.: PCT/IB2006/051338
§ 371 (c)(1),
(2), (4) Date: Nov. 1, 2007

(87) PCT Pub. No.: WO2006/117739
PCT Pub. Date: Nov. 9, 2006

(65) Prior Publication Data

US 2008/0186120 A1 Aug. 7, 2008

(30) Foreign Application Priority Data

May 3, 2005 (EP) ..... 05103666

(51) Int. Cl.
*H01F 5/00* (2006.01)
*H01F 27/30* (2006.01)
*H01F 27/28* (2006.01)

(52) U.S. Cl. ..... 336/200; 336/206; 336/207; 336/208; 336/232

(58) Field of Classification Search ..... 336/200, 336/206–208, 232
See application file for complete search history.

(56) References Cited

U.S. PATENT DOCUMENTS

| | | | | |
|---|---|---|---|---|
| 4,012,703 | A | 3/1977 | Chamberlayne | |
| 5,179,365 | A * | 1/1993 | Raggi | 336/65 |
| 5,402,098 | A * | 3/1995 | Ohta et al. | 336/200 |
| 5,502,430 | A * | 3/1996 | Takahashi et al. | 336/232 |
| 5,559,360 | A * | 9/1996 | Chiu et al. | 257/531 |
| 5,774,349 | A | 6/1998 | Tichy et al. | |
| 5,991,178 | A | 11/1999 | Arnould | |
| 6,157,285 | A * | 12/2000 | Tokuda et al. | 336/200 |
| 6,320,490 | B1 * | 11/2001 | Clayton | 336/180 |
| 6,367,143 | B1 * | 4/2002 | Sugimura | 29/602.1 |
| 6,556,117 | B1 * | 4/2003 | Nakao et al. | 336/105 |
| 2003/0055410 | A1 | 3/2003 | Evans et al. | |
| 2003/0179067 | A1 * | 9/2003 | Gamou et al. | 336/223 |
| 2004/0217443 | A1 | 11/2004 | Davies | |

FOREIGN PATENT DOCUMENTS

| | | | |
|---|---|---|---|
| EP | 0860144 | A2 | 8/1998 |
| WO | WO9319515 | A1 | 9/1993 |
| WO | WO9843258 | A2 | 10/1998 |
| WO | WO03043516 | A2 | 5/2003 |
| WO | WO2005029409 | A2 | 3/2005 |

OTHER PUBLICATIONS

Zumel et al: "Comparative Study of Flex-Foil Technology in HF Planar Transformers Windings"; IEEE Power Electronics Specialist Conference (PESC) 2002, vol. 3, pp. 1248-1253. Shonts, D.: "Improved PFC Boost Choke Using a Quasi-Planar Winding Configuration"; IEEE Applied Power Electronics Conference and Exposition, Dallas, Texas, Mar. 14-18, 1999, vol. 2, pp. 1161-1167.

* cited by examiner

*Primary Examiner* — Elvin G Enad
*Assistant Examiner* — Tszfung Chan

(57) ABSTRACT

A winding arrangement for a planar transformer, e.g., for high frequency AC transformation, or for an inductor includes at least two conduction layers. Each conduction layer has an inner hole and conductor paths which are electrically insulated from each other and which lead from an outer circumference to an inner circumference of the conduction layer adjacent to the inner hole in a spiral form.

24 Claims, 5 Drawing Sheets

WINDING ARRANGEMENT FOR PLANAR TRANSFORMER AND INDUCTOR

The invention relates to a winding arrangement for a planar transformer, in particular for high frequency AC transformation, or for an inductor.

For the purpose of power supply often a voltage has to be transformed to another voltage and the consumer load has be to galvanically isolated from the supplying grid. This is achieved by transformers having a core and primary and secondary windings. Commonly these primary and secondary winding are provided by wire or cord. For some special applications at least one of these windings is formed by a planar winding, e.g. as a conductor strip or foil or a printed circuit board (PCB). An advantage of such an arrangement is a better reproducibility and a reduced capacitance. Planar winding arrangements are known from U.S. Pat. No. 5,166,965, U.S. Pat. No. 5,774,349, U.S. Pat. No. 5,991,178 and WO 93/19515 and are described in "Comparative Study of Flex-Foil Technology in HF Planar Transformers Windings", P. Zumel et al., IEEE Power Electronics Specialist Conference (PESC), Cairns (Australia), June 2002 and in "Improved PFC Boost Choke using a Quasi-Planar Winding Configuration", D. Shonts, Proceeding of the 14$^{th}$ IEEE Applied Power Electronics Conference, Dallas, Tex., USA, Mar. 14-18, (1999). An embodiment of a known planar winding arrangement is illustrated in FIG. 1.

A disadvantage common to all known planar winding arrangements results from the so-called "skin-effect". There is a non-uniform current density along the width of the planar winding path as shown in FIG. 2. This non-uniformity increases with an increasing frequency of the current in the winding leading to undesirable additional power losses.

It is an object of the present invention to provide a winding arrangement for a planar transformer or for an inductor which exhibits the advantages of planar winding arrangements and overcomes the above mentioned drawback by reducing or avoiding the skin-effect, so that a transformation at higher frequencies with a reduced power losses is possible. It is a further object to provide a planar transformer and an inductor comprising such a winding arrangement.

These objects are achieved by a winding arrangement for a planar transformer, in particular for high frequency AC transformation, or for an inductor, including at least two conduction layers, each conduction layer having an inner hole and comprising a plurality of conductor paths, which are electrically insulated from each other and which lead from an outer circumference of said conduction layer to an inner circumference of said conduction layer adjacent to said inner hole in a spiral form and a planar transformer and an inductor comprising said winding arrangement.

Surprisingly, it was found for such an arrangement that the current in each conductor path is the same while the skin-effect in each conductor path is reduced compared to the skin-effect which would be present in one common broad conductor path instead of the spiral shaped conductor paths. The uniformity of the current density is substantially increased even for higher frequencies. Thus, possible power losses are reduced or even avoided.

Said inner hole preventing said conductor paths of one conduction layer from being connected with each other may further be employed for receiving a transformer core or a inductor core.

In an advantageous embodiment of the present invention at least one carrier plate is provided for carrying said conduction layers. The provision of carrying means allows the use of conduction layers and conductor paths which are not able to support themselves, i.e. much smaller and thinner layers and paths. Other carrying means than said carrier plates are also possible. However, said carrier plates have the advantage of supporting the whole structure of said conduction layers. Thus, undesired deformations of said winding arrangements are avoided. If there is no need for a transformer core or a inductor core around which said winding arrangement is to be arranged around, said carrier plate may also be continuous and may be provided with no hole at all.

According to an embodiment of the present invention said conductor paths have substantially identical shapes. By providing substantially identical shapes it is easily ensured that the conductor paths surround substantially identical magnetic fluxes resulting in substantially identical voltages induced to different conductor paths.

In a preferred embodiment said carrier plates are electrically insulating and on each side of said carrier plates a conduction layer is provided, wherein the directions of rotation of the spirals around said inner hole formed by the conductor paths on different sides of a carrier plate are opposite to each other. Two conductor paths, one of the each side of said carrier layer being connected at their, for example, ending points at said inner circumference, result in a path starting at the starting point of one conductor path and ending at the starting point of the other conductor path, wherein said path revolves in one direction of rotation around said inner hole.

In an advantageous embodiment the two conduction layers of each carrier plate have substantially mirrored shapes ensuring substantially induced voltages.

It is further preferred to provide insulation plates between said carrier plates for insulating the conduction layers of adjacent carrier plates from each other. Even if adjacent carrier plates with conduction layers on each side are arranged closely together short circuits are prevented by insulation plates being provided in between the carrier plates.

In another embodiment of the present invention winding arrangement comprises a plurality of winding paths revolving around said inner hole, each winding path comprising a plurality of conductor paths, wherein conductor paths of said plurality of conductor paths are alternately connected at their starting points at said outer circumference and their ending points at said inner circumference, wherein the directions of rotation of the spirals around said inner hole formed by each two connected conductor paths are opposite to each other. A winding path comprises a number of conductor paths of different conduction layers.

For example, said winding path starts at a starting point of a first conductor path at said outer circumference. A second conductor path is connected at its ending point at said inner circumference with the ending point of said first conductor path. Thus, said winding path continues with said second conductor path to the starting point of said second conductor path at said outer circumference. In other words, said winding path includes said first conductor path leading form said outer circumference to said inner circumference and said second conductor paths leading back to said outer circumference. The direction of rotation of said second conductor path is opposite to that of said first conductor path, thus, the course of said winding path follows the revolution of a number of conductor paths around said inner hole.

In yet another embodiment of the present invention the difference of an angle of said starting point of a conductor path at said outer circumference and an angle of an ending point of said conductor path at said inner circumference is a vulgar fraction of 360°, in particular ½, ⅖ or ⅓. A combination of an integer number of conduction layers thus gives a revolution of 360° allowing an easy external connection of said conductor paths. The denominator of said vulgar fraction gives the number of conductor paths needed to achieve a number of revolutions around said inner hole equal to the nominator of said vulgar fraction.

It is further preferred that said starting points of said conductor paths of adjacent conduction layers and/or adjacent carrier plates are rotated by an angle in the range from 0° to 25°, in particular form 5° to 15°, and/or the difference of an angle of a starting point of a conductor path at said outer circumference and an angle of an ending point of said conductor path at said inner circumference differs from 180° or 120° by a value in the range from 0° to 25°, in particular from 5° to 15°. By differences it is achieved that there is a rotational shift between adjacent conduction layers and/or carrier plates resulting in a helix-like combination of conductor paths wherein not only the course of the conductor paths but also a center of symmetry of said course revolves around said inner hole. This allows the winding arrangement and each combination of conductor paths to be symmetric in regard of said inner hole.

It has been found to be advantageous if the number of said plurality of conductor paths on one side of said carrier plate is in the range from 4 to 20, preferably in the range from 6 to 12. This gives a reasonable compromise between the size, i.e. the width, and the number of conductor paths in said conduction layer.

In yet another advantageous embodiment of a winding arrangement according to the present invention N is the number of conductor paths in one conduction layer and adjacent conduction layers are rotated against each other by an angle in the range from 360°/(N+1) to 360°/(N−1). According to this embodiment the ending points of conductor paths which are to be connected are arranged in such a way that a sufficient large area is covered by both conductor paths, i.e. the projections of said conductor paths coincide partially, so that a connection by said two conductor paths can by provided by suitable connection means, for instance, by a bolt extending through both conductor paths or by an accordingly defined conductive part of said carrier plate.

According to a preferred embodiment said carrier plate is a printed circuit board. Techniques for producing printed circuit boards with predetermined shapes of conductor paths are well known and thus it is possible to produce winding arrangements according to the present invention in an easy and inexpensive way.

Further, planar transformers according to the present invention, in particular comprising a winding arrangement as claimed in claim 6, are proposed, wherein said winding paths are connected in parallel when said winding arrangement is provided as a primary winding and/or wherein said winding paths are connected in series when said winding arrangement is provided as a secondary winding. Said winding paths connected in parallel result in fewer windings compared to a connection in series.

In the following the present invention is described further in detail with reference to the accompanying figures, in which.

Figure 4A:
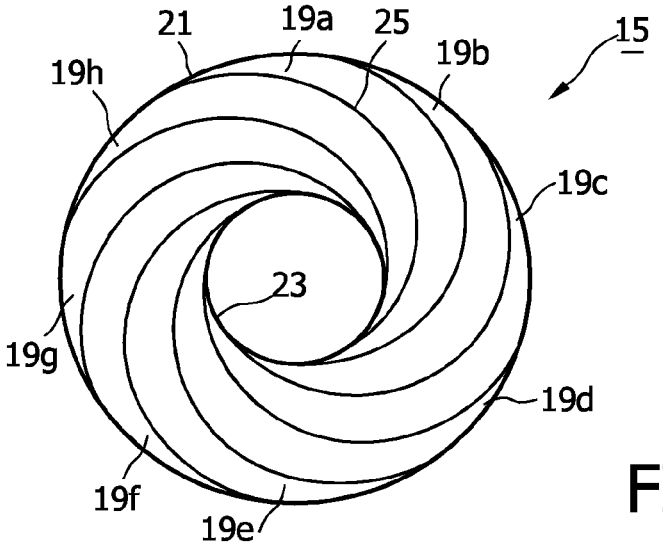
Figure 4B:
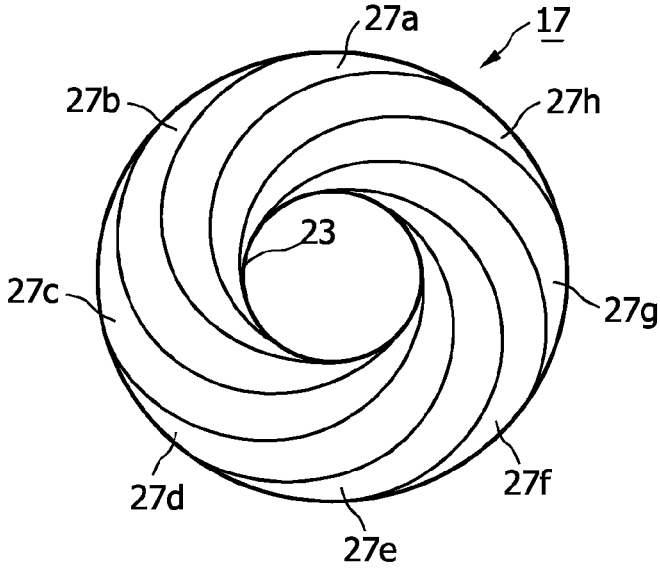
Figure 5:
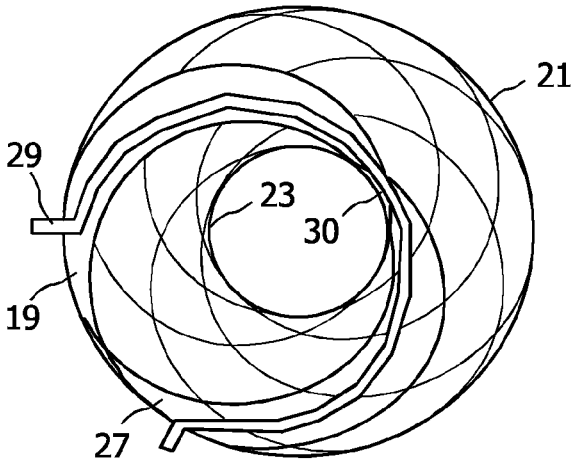
Figure 6:
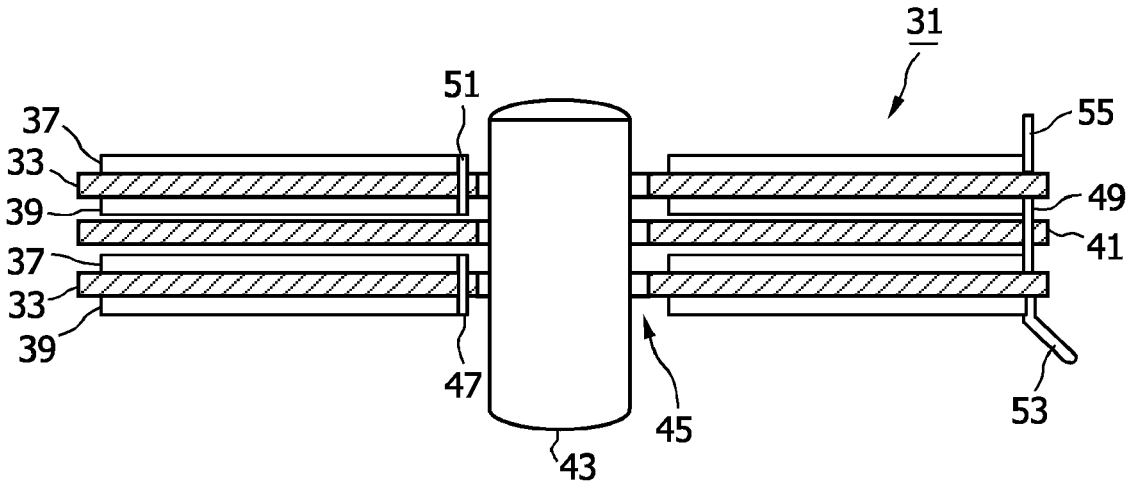
Figure 7A:
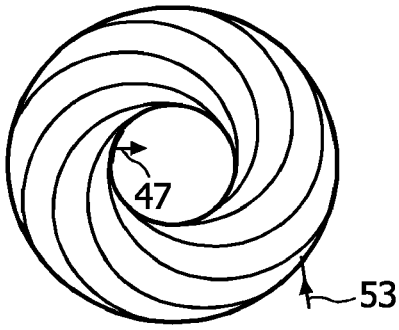
Figure 7B:
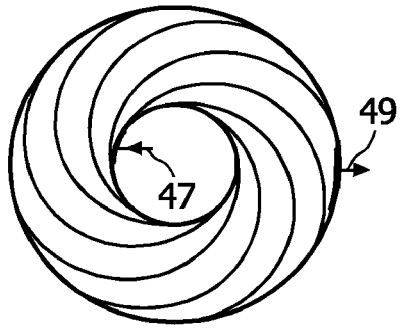
Figure 7C:
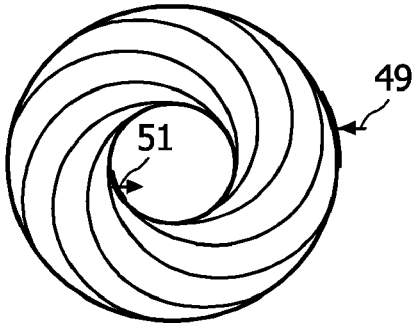
Figure 7D:
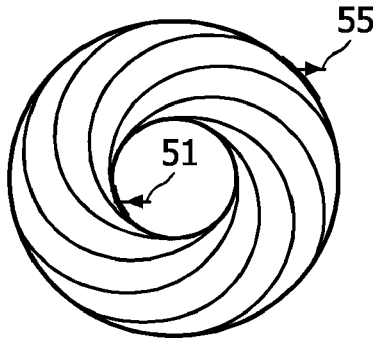
Figure 8:
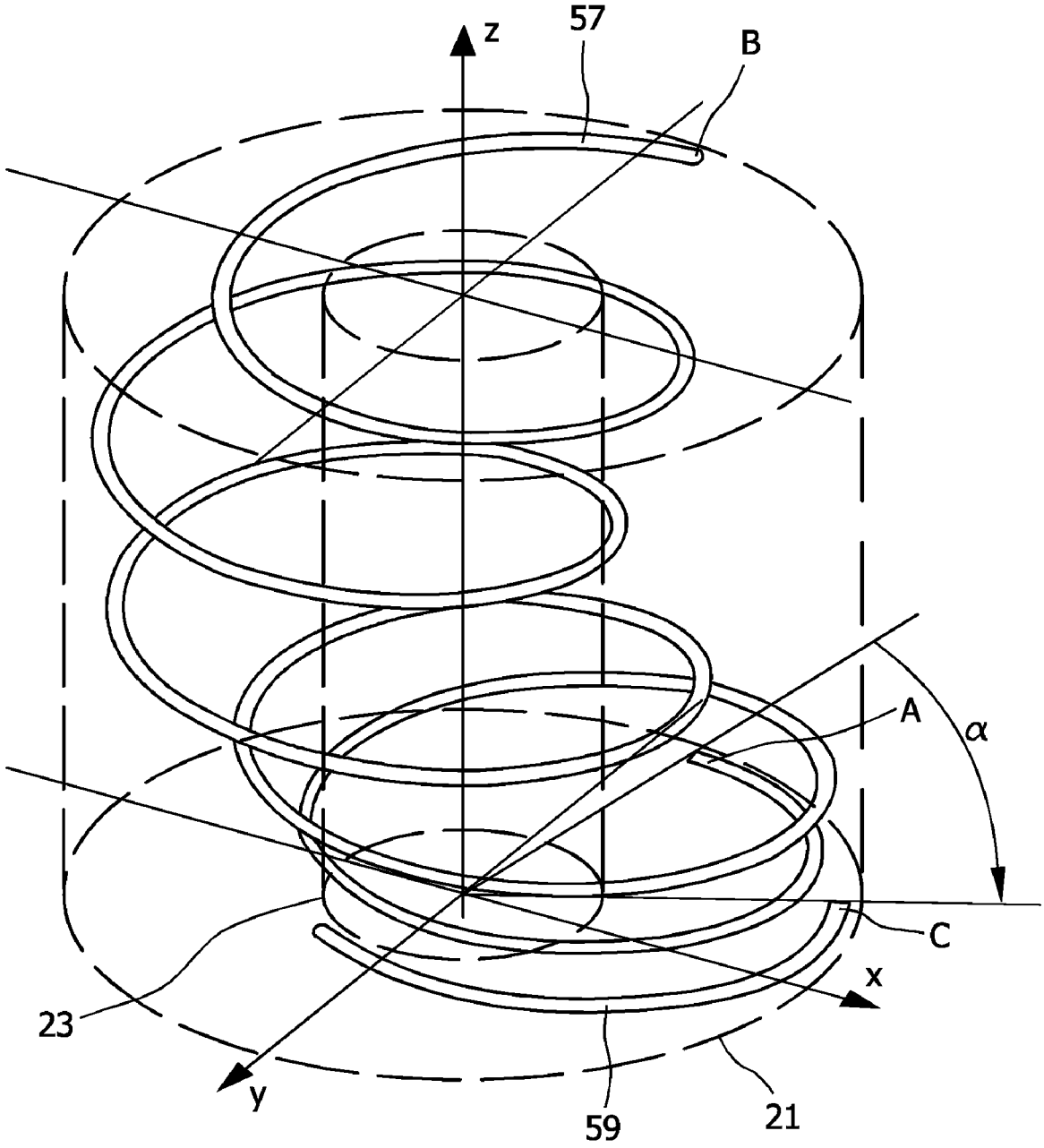
Figure 9:
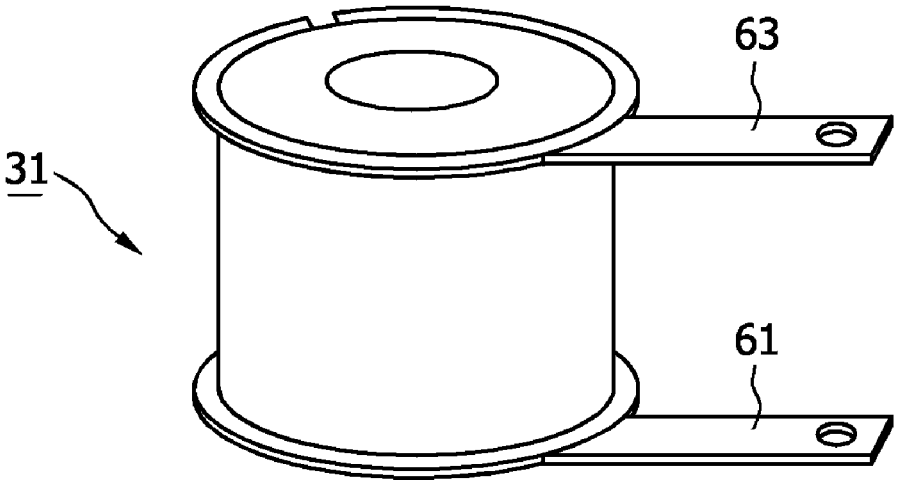
Figure 10:
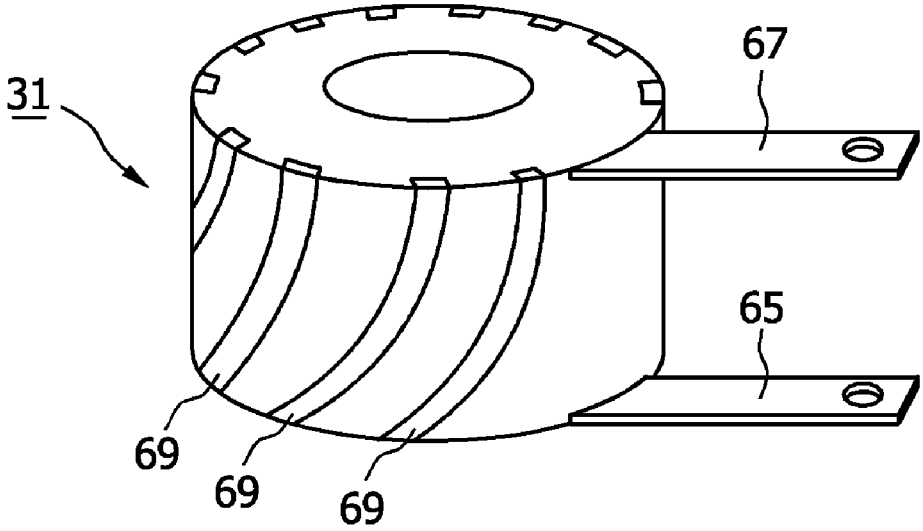

FIG. 4*a* shows a first layout of a conduction layer according to the present invention;

FIG. 4*b* shows a second layout of a conduction layer according to the present invention;

FIG. 5 shows a course of two conductor paths according to said first and said second layout shown in FIGS. 4*a*, 4*b* being connected at their ending points;

FIG. 6 shows a schematic sectional view of a winding arrangement according to the present invention;

FIGS. 7*a*-7*d* illustrate a winding path of the winding arrangement shown in FIG. 6;

FIG. 8 shows a schematic perspective view of a course of a winding path according to the present invention;

FIG. 9 shows a schematic perspective view of a winding arrangement according to the present invention having winding paths connected in parallel and FIG. 10 shows a schematic perspective view of a winding arrangement according to the present invention having winding paths connected in series.

Figure 1:
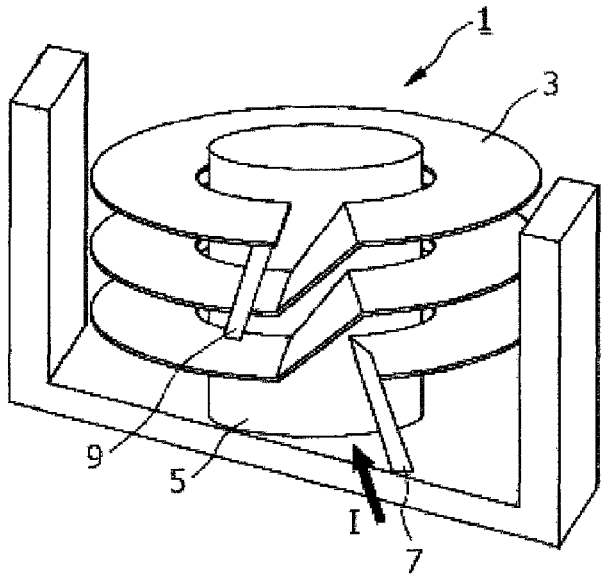
FIG.1 Prior Art
FIG. 1 shows a schematic perspective view of a known winding arrangement for a planar transformer or inductor.
Figure 2:
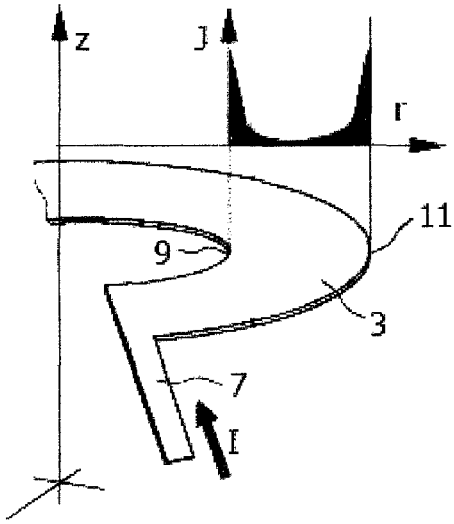
Prior Art FIG.2
FIG. 2 shows a partial winding of the known winding arrangement shown in FIG. 1 and a related current density distribution.
Figure 3:
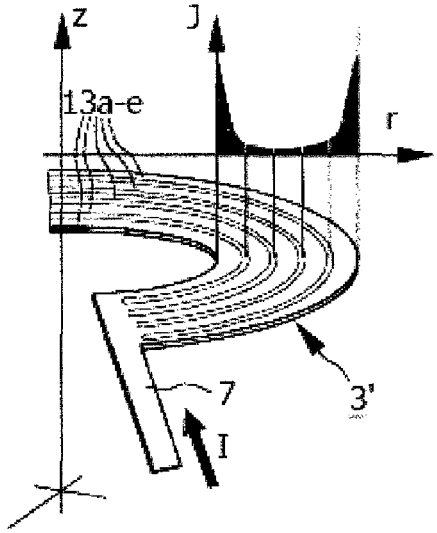
Prior Art FIG.3
FIG. 3 shows a partial winding of another winding arrangement and a related current density distribution.

FIG. 1 shows a schematic perspective view of a known winding arrangement 1 for a planar transformer or inductor. The winding arrangement 1 comprises three windings of a planar conductor 3 revolving around an inner core 5. The planar conductor 3 is provided with two terminals 7, 9 for feeding or collecting a current I flowing through said planar conductor 3. With said winding arrangement 1 being part of a transformer (not shown) a voltage may be induced into said planar conductor 5 in a common way resulting in a current I. This current flowing through the planar conductor 3 will exhibit a current density distribution as shown in FIG. 2. The current density J is comparatively higher at the inner and outer circumference 9, 11 of the planar conductor 3 than at its inner region due to the so-called skin-effect. The skin-effect increases with an increasing frequency of the current and voltage leading to unwanted additional power losses. The provision of a number of separate partial planar conductors 13*a*-*e* forming together a planar conductor 3' as illustrated in FIG. 3 gives substantially the same current density distribution and is therefore no improvement compared to the continuous planar conductor shown in FIGS. 1 and 2.

FIGS. 4*a* and 4*b* show a first and a second layout 15, 17 of a conduction layer of a winding arrangement according to the present invention. Said first and second layout 15, 17 are mirror image-like. Thus, only said first layout 15 is described here in detail since a corresponding description applies to said second layout 17. A conduction layer according to said layout 15 comprises 8 separate conductor paths 19*a*-*h* having identical shapes. Said conductor paths 19*a*-*h* start at an outer circumference 21 of said conduction layer and coil up clockwise to their ending points at the inner circumference 23. Said inner circumference may surround an inner hole for receiving a transformer core. The course of a conductor path 19*a*-*h* follows a spiral forming around one half of a turn around said inner circumference 23. The conductor paths 19*a*-*h* are separated by insulating regions 25 which also follow said spiral.

FIG. 5 shows by example a course 29 of two conductor paths 19, 27 according to said first and said second layout 15, 17 shown in FIGS. 4*a*, 4*b* being connected at their ending points. Two different conduction layers comprise said first and said second layout 15, 17 and are aligned with each other. Said conduction layers may be arranged on different sides of a carrier plate. Conductor path 19 starts at said outer circumference 21, winds around the inner circumference 23 and ends at a position approximately opposite to its starting point at said inner circumference 23. Conductor path 27 also starts at said outer circumference 21, winds around the inner circumference 23 and ends at a position approximately opposite to its starting point at said inner circumference 23, wherein the ending points of said conductor paths 19, 27 approximately coincide. Said course 29 from the starting point of said conductor path 19 to its ending point at said inner circumference 23 to the ending point of said conductor path 27 to the starting point of said conductor path 27 thus forms a partial revolution around said inner circumference 23. Said conductor paths 19, 27 coincide in an connection area 30 of said layouts adjacent to said inner circumference. A conductive bolt (not shown) projecting through both conductor paths 19, 27 forms a connection between them.

FIG. 6 shows a schematic sectional view of a winding arrangement 31 according to the present invention. Said winding arrangement comprises two identical and aligned carrier plates 33 each having two conduction layers 37, 39 arranged on each side of said carrier plates 33. The upper conduction layer 37 has said layout 15 as shown in FIG. 4*a* and the lower conduction layer 39 has said layout 17 as shown in FIG. 4*b*. Between said carrier plates 33 an insulation plate 41 is provided for insulating the lower conduction layer 39 of the upper carrier plate 33 and the upper conduction layer 37 of the lower carrier plate 33. Further, a core 43 is arranged inside the inner holes 45 of said carrier plates 33 and said insulation plate 41. A number of connections 47, 49, 51 are provided between conductor paths of adjacent conduction layers 37, 39 forming a winding path. For clarity's sake only the connections of one winding path are shown in FIG. 6 and FIGS. 7*a*-7*d*. Said winding path is provided with two terminal points 53, 55.

The course of said winding path of said winding arrangement shown in FIG. 6 is illustrated in FIGS. 7*a*-7*d*. The winding path starts at said terminal point 53 at said lower conduction layer 39 of said lower carrier plate 33, winds around said core 43 (FIG. 7*a*), follows said connection 47 between said lower conduction layer 39 and said upper conduction layer 37 of said lower carrier plate 33 (FIGS. 7*a*, 7*b*), winds around said core 43 (FIG. 7*b*), follows said connection 49 between said upper conduction layer 37 of said lower carrier plate 33 and said lower conduction layer 39 of said upper carrier plate 33 (FIGS. 7*b*, 7*c*), winds around said core 43 (FIG. 7*c*), follows said connection 51 between said lower conduction layer 39 and said upper conduction layer 37 of said upper carrier plate 33 (FIGS. 7*c*, 7*d*), winds around said core 43 (FIG. 7*d*) and ends at said terminal point 55.

FIG. 8 shows a schematic perspective view of a course of a winding path 57 according to the present invention. In order to improve clarity said winding path 57 is shown as a continuous path wherein indications of said conduction layers and said connections are omitted. Said winding path 57 starts at point A at said outer circumference 21, revolves around said inner circumference 23 and ends at point B said at said outer circumference 21. The center of revolution of said winding path 57 around said inner circumference 23 also revolves around said inner circumference 23. Said winding path 57 thus forms a helix which is winded around said inner circumference 23. A part of a second winding path 59 is shown starting form point C. Said second winding path 59 corresponds to said first winding path 57 while being rotated with an angle a against said first winding path 57. Effects of the winded helix are a symmetry of the resulting magnetic field around said inner circumference 23 and a symmetry of the induced voltages/currents.

A winding arrangement 31 according to the present invention comprising conduction layers according to the layouts shown in FIG. 4*a*, 4*b* comprises 8 winding paths 57. FIG. 9 shows a schematic perspective view of a winding arrangement 31 having winding paths 57 connected in parallel. The ends of said winding paths 37 are connected to respective common terminals 61, 63, wherein said terminal 61, 63 are interrupted in order to avoid short circuits within said terminals. FIG. 10 shows a schematic perspective view of a winding arrangement 31 having winding paths 57 connected in series. A first terminal 65 is provided at the starting point of a first winding path 57. Said winding path 57 is connected at its ending point to a starting point of another winding path 57 by a connection 69 and so on. The last winding path 57 is provided with a second terminal 67.

In the embodiments illustrated in the figures the starting points of said paths and the terminals are provided at said outer circumference. However, it has to be noted that terminals, connections and the like may also be provided at said inner circumference and at both inner and outer circumference. Further, it is possible to connect said conduction layers and conductor paths in different ways. The invention is not limited to connections between directly adjacent conductor paths or conduction layers. Also, the carrier plates may be stacked in different ways. The invention is also not limited to circular core arrangements since other forms are possible as well. Further, the connection of winding paths in series and in parallel may be combined.

A possible method for manufacturing a winding arrangement according to the present invention is to provide printed circuit boards on both sides with said conduction layers and to stack said printed circuit boards with insulation plates in between. Another possible method is to start with a single printed circuit board, to arrange an insulation or spacing layer on top of one side of it and to provide on top of said insulation or spacing layer another conduction layer and so on, by turns. An easy way to connect conductor paths of different conduction layers is to put an electroconductive bolt through them and their separating layers.

The present invention is not limited to a winding arrangement comprising carrier plates for carrying said conduction layers. Said conduction layers and conductor paths may also be constructed in such a way that they are mechanically strong enough to carry themselves without need for a further support. Suitable carrying means may also be provided in form of carrying rods, for example. Another possibility is to embed said conduction layers in a resin of some other suitable material for supporting said conduction layers.

By way of example the present invention is described having conductor paths with a decreasing width from said outer circumference to said inner circumference being separated by insulation areas with a constant width. However, it is also possible to provide conductor paths with substantially constant width wherein the width of said insulation areas is changing. It is further possible to provide a combination of these general layouts or other similar layouts.

By means of a suitable spatial arrangement of conductor paths or winding paths in a magnetic field (cf. FIG. 8) it is possible to achieve substantially identical induced voltages $U_{ab}=\int B\, dA_1$ in each conductor path or winding path ensuring a substantially identical currents in each conductor path or winding path. With the conductor paths or winding paths having substantially identical geometries (at least in a projection along a center line) relative to the center line, the magnetic flux comprised by each conductor path or winding path is the same. Thus, the currents and current densities in the conductor paths or winding paths are the same. To ensure equal current densities for a current-fed winding arrangement the winding paths may be fed by sources providing the same current.

According to the present invention a winding arrangement is proposed which avoids or reduces the "skin-effect" so that the winding arrangement may be used with higher frequencies and lower power losses. Such a winding arrangement may, for instance, be used in applications in which a planar, printed circuit board winding is utilized and a high frequency is used like high voltage transformers for X-ray tubes.

The invention claimed is:

1. A planar winding arrangement comprising at least two conduction layers, one conduction layer of the at least two conduction layers having an inner hole and comprising conductor paths, wherein the conductor paths are electrically insulated from each other and lead from starting points on an outer circumference of said at least one conduction layer to an inner circumference of said at least one conduction layer adjacent to said inner hole in a spiral form, and wherein the conductor paths form less than one turn of the spiral form between the outer circumference and the inner circumference, wherein the starting points are evenly dispersed throughout the outer circumference.

2. The planar winding arrangement of claim 1, further comprising carrier plates, wherein at least one carrier plate of the carrier plates is configured for carrying said at least two conduction layers.

3. The planar winding arrangement of claim 1, wherein said conductor paths have substantially identical shapes.

4. The planar winding arrangement of claim 2, wherein said carrier plates are electrically insulating and on each side of said carrier plates a conduction layer is provided, wherein directions of rotation of spirals around said inner hole formed by the conductor paths on different sides of a carrier plate are opposite to each other.

5. The planar winding arrangement of claim 4, wherein the at least two conduction layers of the at least one carrier plate have substantially mirrored shapes.

6. The planar winding arrangement of claim 4, wherein insulation plates are provided between said carrier plates for insulating the at least two conduction layers of adjacent carrier plates from each other.

7. The planar winding arrangement of claim 1, comprising a plurality of winding paths revolving around said inner hole starting and ending at said inner circumference or said outer circumference, each winding path comprising conductor paths, wherein the conductor paths of said plurality of winding paths are alternately connected at their starting points at said outer circumference and their ending points at said inner circumference, wherein directions of rotation of spirals around said inner hole formed by each two connected conductor paths are opposite to each other.

8. The planar winding arrangement of claim 1, wherein an angle from said starting point of a conductor path at said outer circumference to an ending point of said conductor path at said inner circumference is a fraction of 360°, comprising one of: ½, ⅖ or ⅓.

9. The planar winding arrangement of claim 1, wherein said starting points of said conductor paths of adjacent conduction layers and/or adjacent carrier plates are rotated by an angle from 0° to 25°.

10. The planar winding arrangement of claim 1, wherein an angle from a starting point of a conductor path at said outer circumference to an ending point of said conductor path at said inner circumference is between about 105° and about 135° or between about 165° and about 195°.

11. The planar winding arrangement of claim 1, wherein a number of said conductor paths in one conduction layer is from 6 to 12.

12. The planar winding arrangement of claim 1, wherein N is a number of the conductor paths in one conduction layer and wherein adjacent conduction layers are rotated against each other by an angle from 360°/(N+1) to 360°/(N−1).

13. The planar winding arrangement of claim 2, wherein said at least one carrier plate is a printed circuit board.

14. The planar winding arrangement of claim 1, wherein the conductor paths form half a turn of the spiral form between the outer circumference and the inner circumference of said at least one conduction layer.

15. The planar winding arrangement of claim 1, wherein at least one of the conductor paths has a width which decreases from said outer circumference to said inner circumference.

16. The planar winding arrangement of claim 15, wherein the conductor paths are separated by insulation areas, and wherein a width of the insulation areas is constant.

17. The planar winding arrangement of claim 1, wherein the conductor paths are separated by insulation areas, and wherein a width of the insulation areas is changing.

18. The planar winding arrangement of claim 1, wherein the conductor paths of the one conduction layer have curved spiral forms and are not parallel to each other.

19. A planar transformer for high frequency AC transformation, comprising a transformer core and a first winding arrangement and a second winding arrangement provided around said transformer core, at least one of said winding arrangements being a planar winding arrangement comprising at least two conduction layers, one conduction layer of the at least two conduction layers having an inner hole and comprising conductor paths which are electrically insulated from each other and which lead from starting points on an outer circumference of said at least one conduction layer to an inner circumference of said at least one conduction layer adjacent to said inner hole in a spiral form, and wherein at least one conductor path of the conductor paths forms less than one turn of the spiral form between the outer circumference and the inner circumference, wherein the starting points are evenly dispersed throughout the outer circumference.

20. The planar transformer of claim 19, wherein the conductor paths form half a turn of the spiral form between the outer circumference and the inner circumference of said at least one conduction layer.

21. A planar transformer for high frequency AC transformation, comprising a transformer core and a first winding arrangement and a second winding arrangement provided around said transformer core, at least one of said winding arrangements comprising at least two conduction layers, at least one conduction layer of the at least two conduction layers having an inner hole and comprising conductor paths which are electrically insulated from each other and which lead from starting points on an outer circumference of said at least one conduction layer to an inner circumference of said at least one conduction layer adjacent to said inner hole in spiral form, wherein the conductor paths are alternately connected at their starting points at said outer circumference and their ending points at said inner circumference as a primary winding, wherein said conductor paths are connected in parallel, and wherein at least one conductor path of the conductor paths forms less than one turn of the spiral form between the outer circumference and the inner circumference, wherein the starting points are evenly dispersed throughout the outer circumference.

22. A planar transformer for high frequency AC transformation, comprising a transformer core and a first winding arrangement and a second winding arrangement provided around said transformer core, at least one of said winding arrangements comprising at least two conduction layers, at least one conduction layer of the at least two conduction layers having an inner hole and comprising conductor paths which are electrically insulated from each other and which lead from starting points on an outer circumference of said at least one conduction layer to an inner circumference of said at least one conduction layer adjacent to said inner hole in spiral form, wherein the conductor paths are alternately connected at their starting points at said outer circumference and their ending points at said inner circumference as a secondary winding, wherein said conductor paths are connected in series, and wherein at least one conductor path of the conductor paths forms less than one turn of the spiral form between the outer circumference and the inner circumference, wherein the starting points are evenly dispersed throughout the outer circumference.

23. An inductor comprising a winding arrangement comprising at least two conduction layers, at least one conduction layer of the at least two conduction layers having an inner hole and comprising conductor paths, wherein the conductor paths are electrically insulated from each other and which lead from starting points on an outer circumference of said at least one conduction layer to an inner circumference of said at least one conduction layer adjacent to said inner hole in a spiral form, and wherein the conductor paths form less than one turn of the spiral form between the outer circumference and the inner circumference, wherein the starting points are evenly dispersed throughout the outer circumference.

24. The inductor of claim 23, wherein the conductor paths form half a turn of the spiral form between the outer circumference and the inner circumference of said at least one conduction layer.

* * * * *